US007407419B2

(12) United States Patent
Douglas

(10) Patent No.: US 7,407,419 B2
(45) Date of Patent: Aug. 5, 2008

(54) OUTBOARD ENGINE MOUNTING ASSEMBLY

(76) Inventor: Patrick Douglas, 144 Lismore Park, Waterford (IE)

( * ) Notice: Subject to any disclaimer, the term of this patent is extended or adjusted under 35 U.S.C. 154(b) by 0 days.

(21) Appl. No.: 11/614,235

(22) Filed: Dec. 21, 2006

(65) Prior Publication Data

US 2007/0218784 A1 Sep. 20, 2007

(30) Foreign Application Priority Data

Dec. 21, 2005 (IE) ..... S2005/0853

(51) Int. Cl.
*B63H 20/08* (2006.01)

(52) U.S. Cl. ..... 440/53; 248/640

(58) Field of Classification Search ..... 440/53, 440/58, 59; 248/640, 642
See application file for complete search history.

(56) References Cited

U.S. PATENT DOCUMENTS

| | | | | |
|---|---|---|---|---|
| 2,928,630 | A | 3/1960 | Wisman | |
| 3,948,204 | A | 4/1976 | Brock et al. | |
| 4,279,602 | A | 7/1981 | Alter | |
| 4,668,197 | A | 5/1987 | Proto | 440/54 |
| 4,824,067 | A | 4/1989 | O'Brien | 248/642 |
| 4,842,559 | A | 6/1989 | Litjens et al. | 440/53 |
| 4,907,993 | A | 3/1990 | Thompson | |
| 5,113,791 | A | 5/1992 | Rottschafer | 248/642 |
| 5,322,030 | A | 6/1994 | Brehmer | |
| 5,382,183 | A | 1/1995 | Rompre | 440/59 |
| 5,522,578 | A | 6/1996 | Mayfield | 248/642 |
| 5,944,568 | A | 8/1999 | Rabal | |
| 6,390,864 | B1 | 5/2002 | Jenkins | 440/53 |
| 6,652,335 | B1 | 11/2003 | Peschmann et al. | 440/59 |

FOREIGN PATENT DOCUMENTS

| | | |
|---|---|---|
| DE | DE 20010521 U | 11/2000 |
| EP | 0105071 | 4/1984 |
| FR | 2713589 | 6/1995 |
| GB | 1129478 | 10/1968 |
| GB | GB 2035934 | 6/1980 |
| GB | GB 2084950 | 4/1982 |
| WO | WO 9006883 | 6/1990 |

*Primary Examiner*—Lars A. Olson
(74) *Attorney, Agent, or Firm*—Scott E. Kamholz; Foley Hoag LLP

(57) ABSTRACT

An assembly for mounting an auxiliary outboard engine on a boat has a support frame with attachment means for mounting the support frame in an inclined position between a transom of the boat and a rear edge of a bathing platform projecting outwardly of the transom. An engine mount is slidable up and down the support frame to move an outboard engine carried on the mount in use between a lowered operating position in the water and a raised stored position above the bathing platform.

20 Claims, 7 Drawing Sheets

OUTBOARD ENGINE MOUNTING ASSEMBLY

CROSS-REFERENCE TO RELATED APPLICATIONS

This application claims the benefit under 35U.S.C. § 119 (*a*)-(*d*) to Irish Patent Application No. S2005/0853, filed Dec. 21, 2005, which is hereby incorporated herein by reference.

This invention relates to an engine mounting assembly and in particular to an outboard engine mounting assembly for mounting an auxiliary outboard engine on a boat. The invention is particularly concerned with boats having a bathing platform projecting rearwardly of the transom of the boat.

BACKGROUND

Many motor boats which are used for fishing have a relatively powerful inboard engine for powering the boat. When fishing by trolling for example the boat is slowly moved through the water. The main inboard engine is not really suitable for this, although it can be used. However, a smaller engine would be more efficient. To this end an outboard engine is sometimes hung on the transom of the boat and run, with the main engine off, to slowly move the boat through the water when trolling. However, the outboard engine may overhang the stern of the boat by about 1 meter. This has a number of disadvantages. Firstly, there is a danger of damaging the outboard engine, particularly when manoeuvring the boat in confined spaces such as when mooring the boat for example. Also, the increased length means a longer mooring berth is required for the boat and this can increase the mooring charges.

It is known in the art, see for example GB 1 129 478, U.S. Pat. No. 4,668,197 and U.S. Pat. No. 4,279,602 to provide an auxiliary engine such as an outboard motor in a purpose-built compartment at the aft end of a boat. The outboard motor can be moved on a support frame between a raised stored position within a compartment and a lowered deployed position in the water for powering the boat. This arrangement requires the building of a compartment into the boat to house the auxiliary engine and generally would have to be incorporated in the boat design when building the boat. It would certainly be difficult to fit such a compartment to a boat after construction of the boat. Furthermore, considerable space is required within the hull at the aft end of the boat to accommodate the compartment. Such space is not always readily available, particularly for example when an inboard engine is provided in the boat as the primary propulsion system for the boat. In U.S. Pat. No. 6,390,864 there is disclosed a sliding mount for mounting an outboard motor on a boat. The mount can slide between a raised horizontal position on the deck and a lowered vertical position behind the transom to support the outboard motor in the water for powering the boat. Another outboard engine support is disclosed in U.S. Pat. No. 2,928,630 which is operable for sliding the outboard engine up and down on the transom of a boat between a raised position and a lowered in-use position. The support and the outboard engine overhang the stern of the boat in both the raised and lowered positions. The support when raised can be pivoted into the boat to invert the engine for maintenance if required.

The present invention is directed towards overcoming the aforementioned problems.

SUMMARY OF THE INVENTION

According to the invention there is provided an outboard engine mounting assembly for mounting an outboard engine on a boat having a bathing platform spaced downwardly from a top of a transom of the boat and projecting rearwardly from the transom, the assembly including:

- a support frame having a front end and a rear end;
- attachment means for attachment of said support frame to the boat,
- an engine mount for receiving and supporting an outboard engine,
- said engine mount being slidably movable on the support frame between a lowered engine operating position for supporting the engine with its propeller in the water and a raised stored position for supporting the engine out of the water,
- the attachment means being adapted for mounting the support frame at a desired inclination on the boat extending upwardly and forwardly from the rear end to the front end of the support frame with the rear end of the support frame mounted at a rear edge of the bathing platform and the support frame and engine mount cooperate for supporting the engine forwardly of the rear end of the support frame when the engine mount is in the raised stored position.

The engine is movable on the mounting assembly between a lowered in-use position substantially fully overhanging the boat and a raised stored position substantially forward of a rear extremity of the boat. In other words, in the stored position it does not increase the length of the boat. Also it is less likely to be damaged in the raised stored position. Further, removing the engine from the water prevents the build up of seaweed and the like on the engine. When moored at a marina, the raised engine provides increased security as it is easier for CCTV security monitors to see the engine. Another advantage of the invention is that when the engine is in the raised stored position it is easier to work on for maintenance.

In one embodiment, the carriage and the support frame are adapted to support the engine between the front end and the rear end of the support frame when the carriage is in the raised position.

In another embodiment, the engine mount supports the engine in an upright position in both the raised and lowered positions.

In one embodiment of the invention the attachment means is adjustable on the support frame.

In another embodiment the attachment means comprises an upper mounting bracket secured at an upper forward end and a lower mounting bracket secured at a lower rear end of the support frame, at least one of said mounting brackets being adjustable on the support frame to vary the distance on the mounting brackets.

In a further embodiment the mounting brackets are pivotally attached to the support frame.

In another embodiment the upper mounting bracket has a pair of arms which extend outwardly from the support frame for bridging across a guardrail on the boat.

In a particularly preferred embodiment of the invention the engine mount is slidably mounted on the support frame for movement between the lowered position and the raised position.

Preferably the support frame is adapted to be supported in an inclined position at the rear of the boat for sliding the engine between the raised and lowered positions.

Conveniently the engine mount has a carriage which slidably engages a complementary slide rail on the support frame.

In one embodiment the carriage has rollers which engage in associated channel slide rails on the support frame. Preferably, a pair of spaced-apart in-turned channels are provided on the support frame for reception of laterally projecting rollers roatably mounted at each side of the carriage. Alternatively the carriage may be provided with slide shoes which engage and move along the associated channel slide rails on the support frame.

In another embodiment, the support frame and the attachment means cooperate to allow adjustment of the inclination of the support frame between 20° and 60° to the horizontal.

Preferably locking means is provided for releasably locking the carriage on the support frame.

In another embodiment the engine mount includes an engine mounting block, said engine mounting block being pivotally mounted on the carriage.

In a further embodiment means is provided for releasably locking the mounting block on the carriage and for adjusting the orientation of the mounting block relative to the carriage.

In another embodiment the carriage has an engine mounting block pivotally mounted thereon for pivoting about a horizontal pivot between the engine mounting block and the carriage, and an adjuster link arm extends between the engine mounting block and the carriage, one or both ends of said link arm being adjustably engaged with the carriage and/or the engine mounting block for adjustment of the angle of the engine mounting block relative to the carriage.

In another embodiment, an outer end of the link arm is vertically adjustable on the engine mounting block.

In another embodiment, the outer end of the link arm is engaged with a rearwardly projecting web on the engine mounting block, said web having a number of vertically spaced through holes, a bolt connecting between the outer end of the link arm and a selected one of said through holes in the web.

In another embodiment, an inner end of the link arm is longitudinally adjustable on the carriage for movement towards and away from the engine mounting block.

In another embodiment, an elongate bar on the carriage has a number of spaced-apart through holes, a bolt connecting between the inner end of the link arm and a selected one of said through holes in the bar.

In another embodiment, the carriage has an inner slide plate in alignment with the slide rails of the support frame and an outer engine support portion angled relative to the slide plate and projecting outwardly between the slide rails, the engine mounting block being pivotally mounted at an outer end of the engine support portion.

In another embodiment the attachment means is pivotally engaged with the support frame.

In a further embodiment the attachment means comprises a pair of spaced-apart mounting brackets on the support frame for engagement with the boat to mount the support frame on the boat.

Conveniently at least one of said mounting brackets may be provided with a number of associated spaced-apart mounting positions on the support frame to provide adjustment for mounting the support frame on different boats.

In another embodiment a winch is mounted on the support frame and is operable to raise and lower the engine mount on the support frame. Various other mechanisms might alternatively be provided which facilitate raising and lowering the engine mount with the outboard engine mounted thereon.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF PREFERRED EMBODIMENTS

Figure 1:
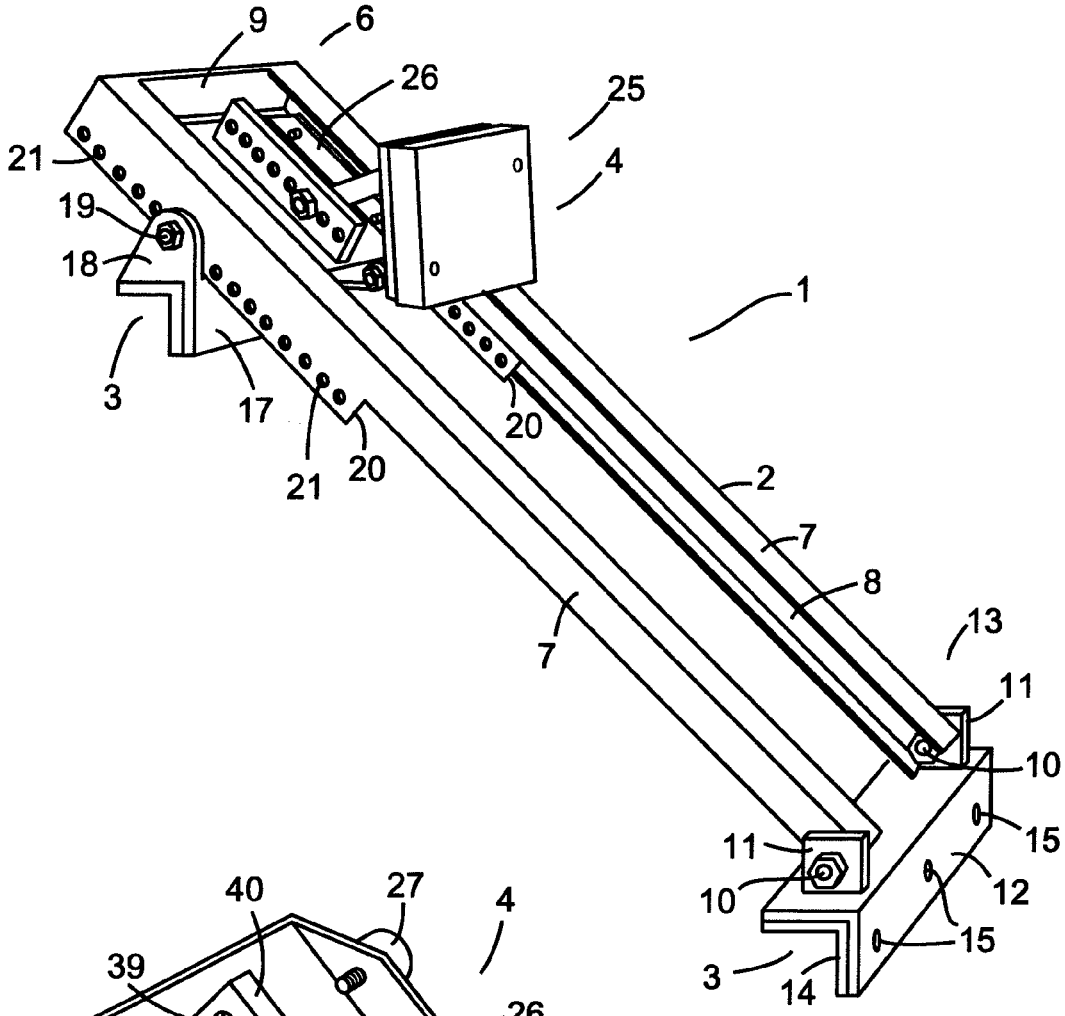
FIG. 1 is a perspective view of an outboard engine mounting assembly according to the invention.
Figure 2:
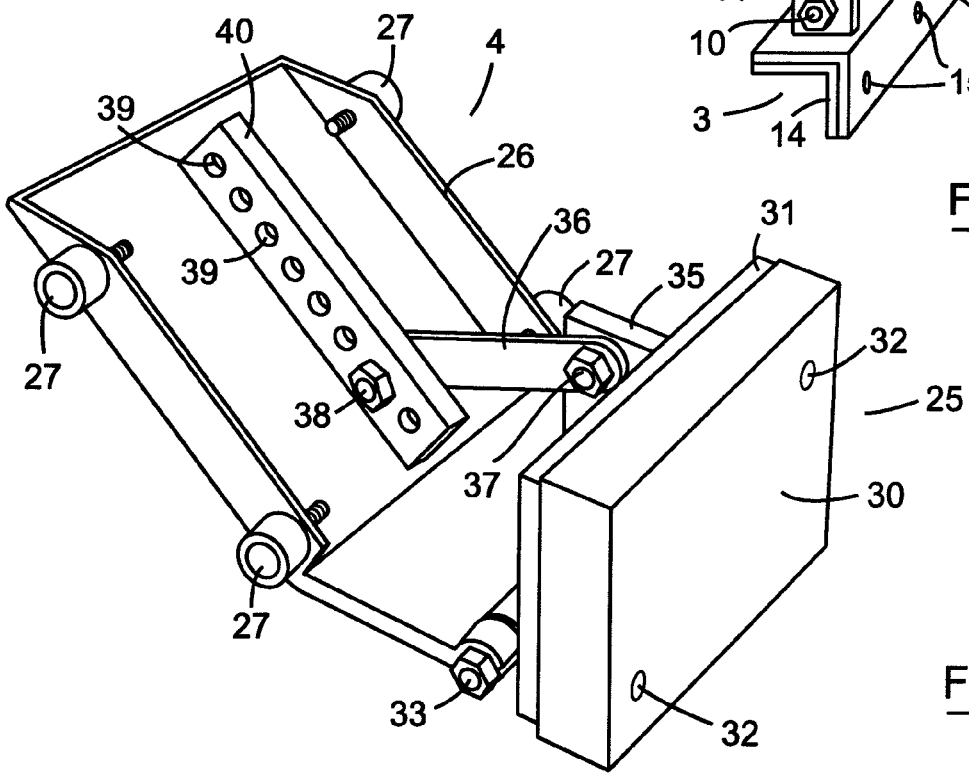
FIG. 2 is a detail perspective view of an engine mount forming portion of the assembly.

Referring to the drawings and initially to FIGS. 1 to 4 thereof, there is illustrated an outboard engine mounting assembly according to the invention indicated generally by the reference numeral 1.

Figure 3:
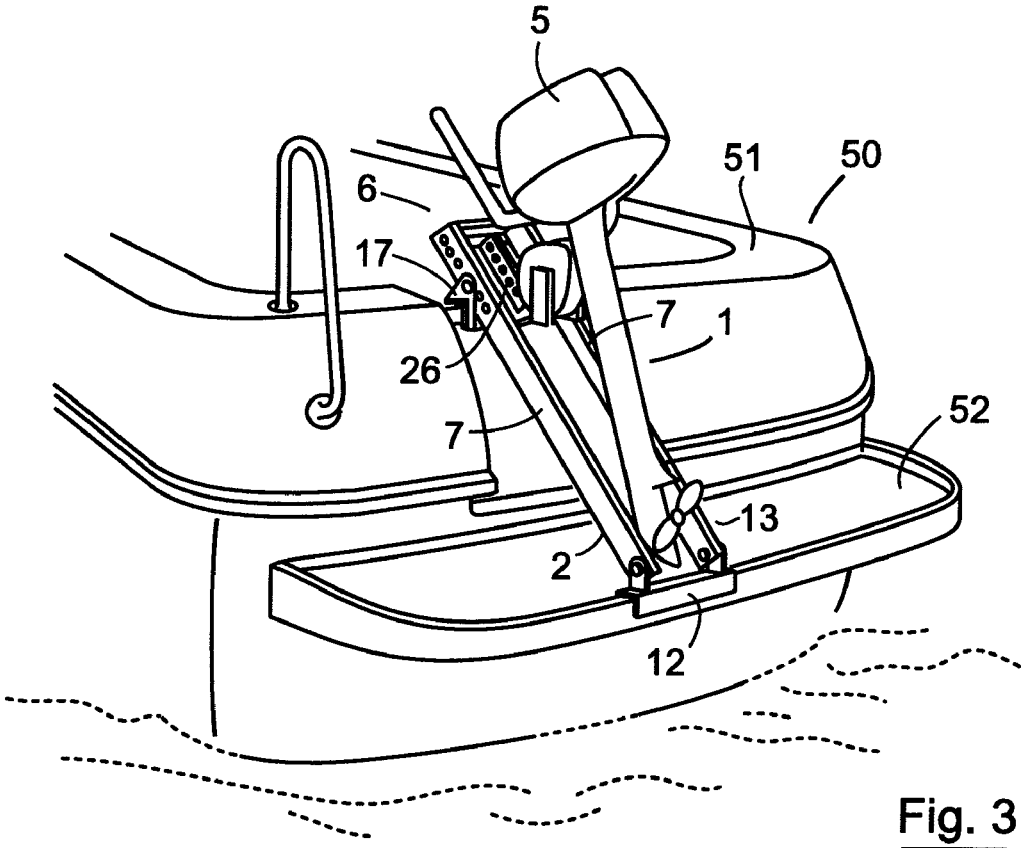
FIG. 3 is a perspective view showing the assembly mounted on a boat, supporting an outboard engine in one position of use.
Figure 4:
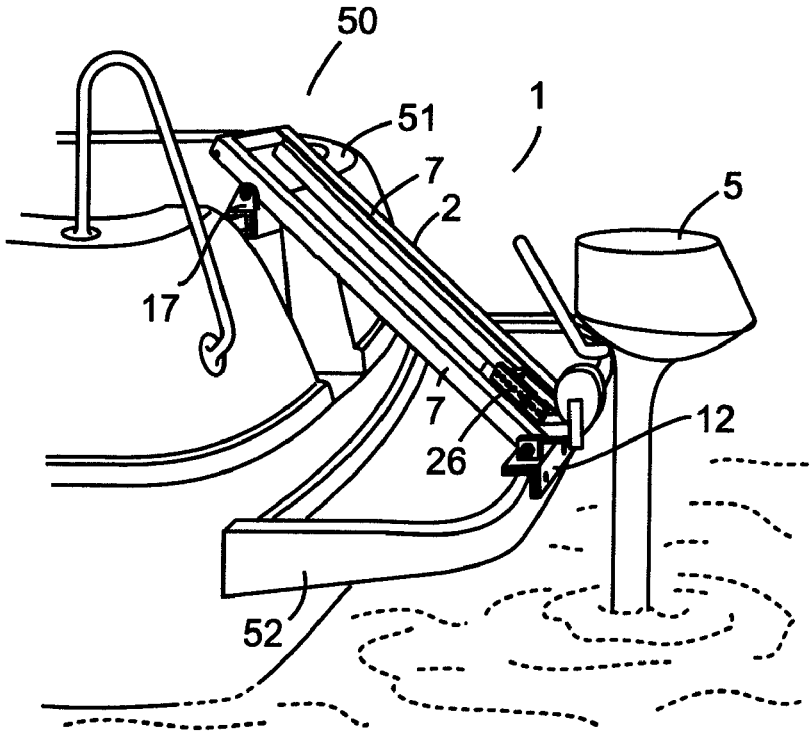
FIG. 4 is a perspective view showing the assembly mounted on a boat, supporting an outboard engine in another position of use.
Figure 5:
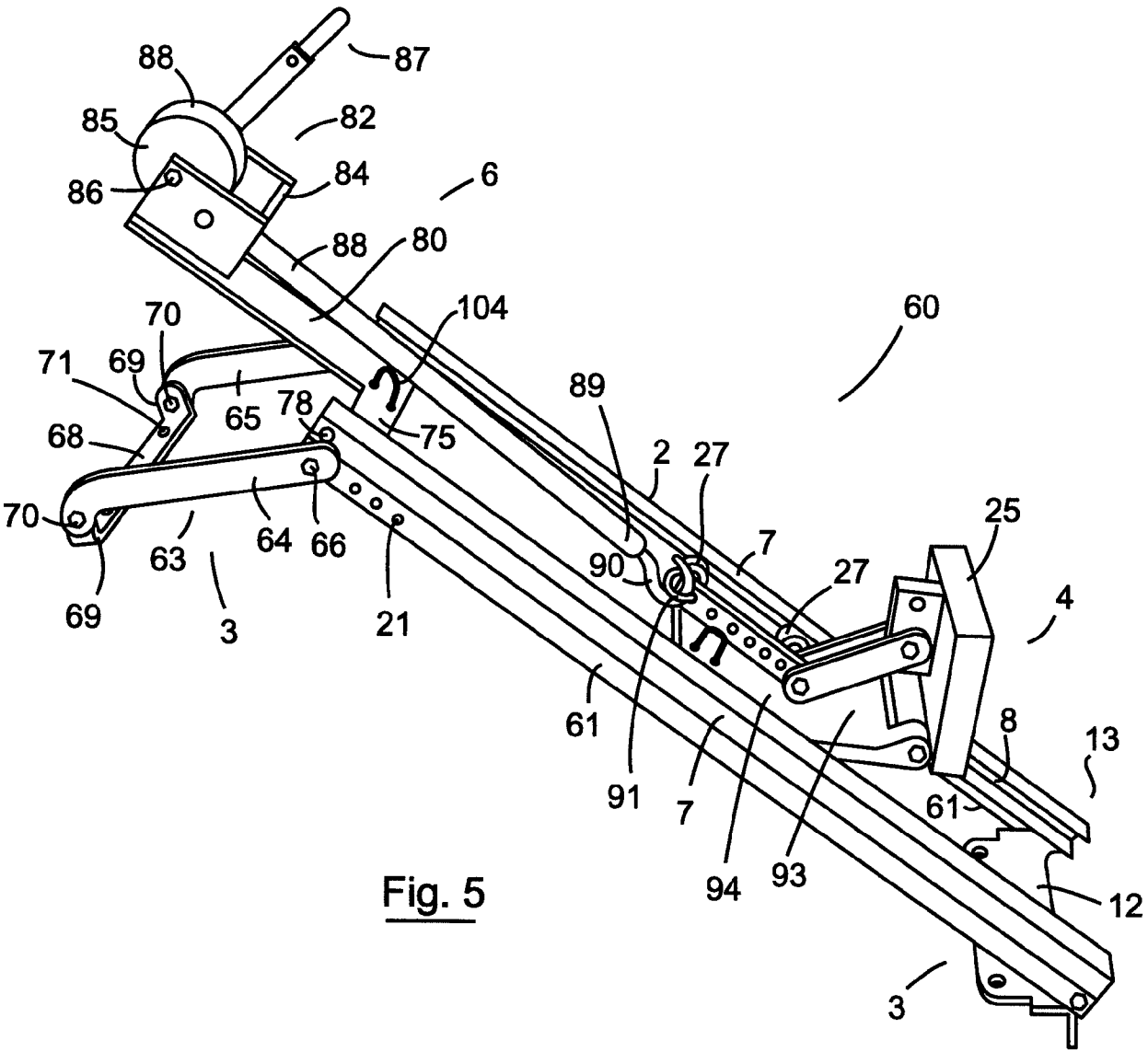
FIG. 5 is a perspective view showing another outboard engine mounting assembly according to a second embodiment of the invention.
Figure 6:
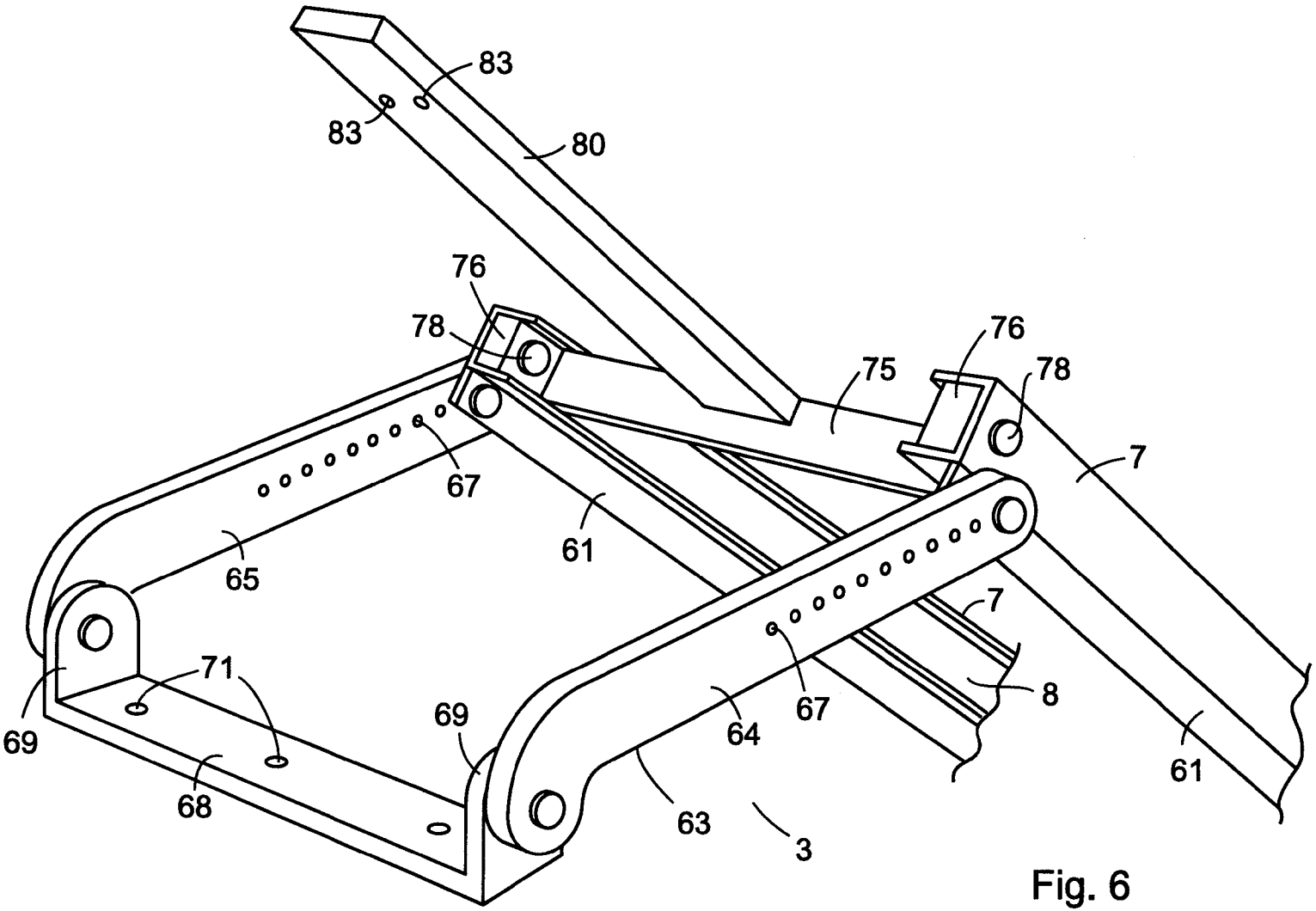
FIG. 6 is a detail perspective view showing portion of the mounting assembly shown in FIG. 5.
Figure 7:
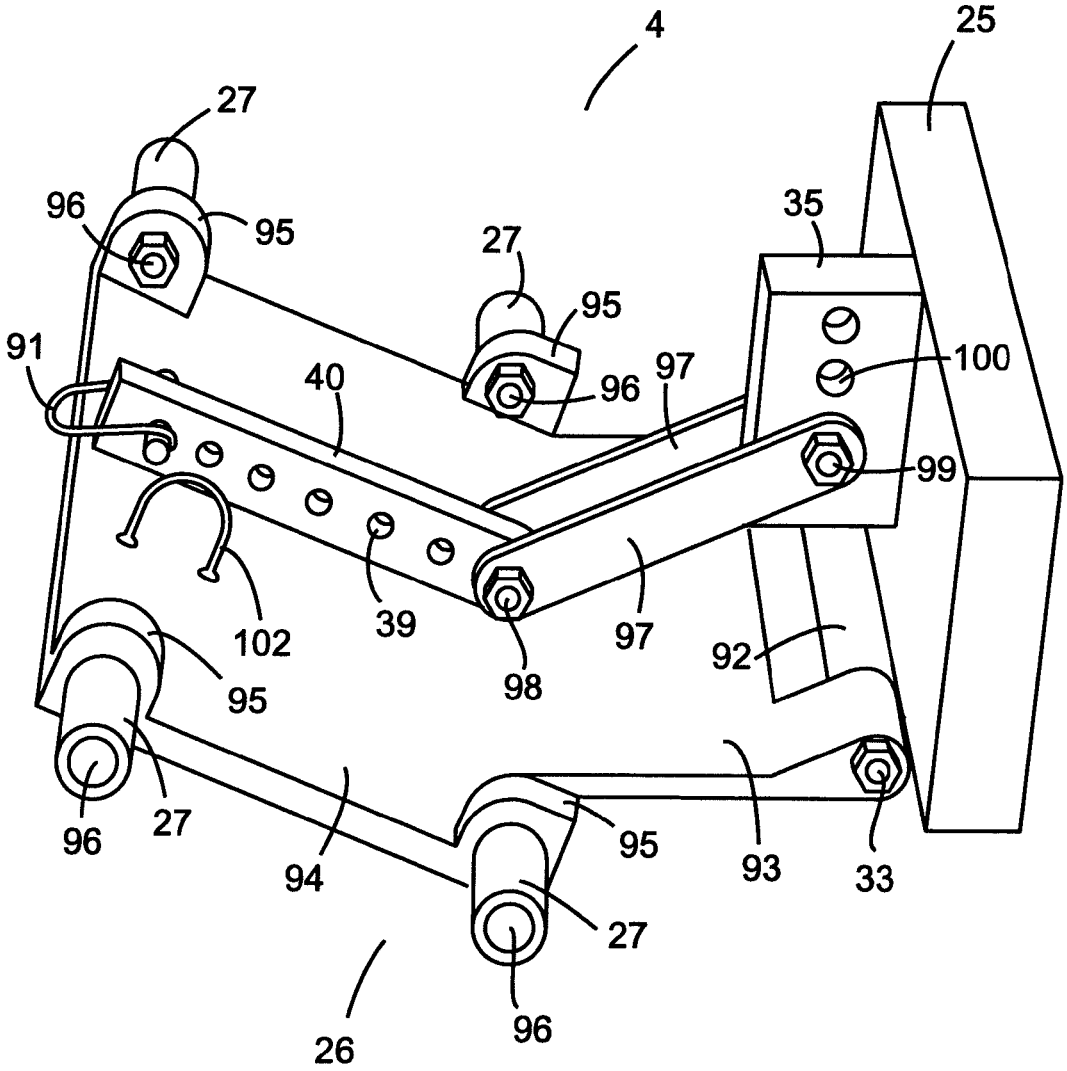
FIG. 7 is a detail perspective view of an engine mount portion of the mounting assembly of FIG. 5.

The assembly 1 comprises a support frame 2 having attachment means indicated generally by the reference numeral 3 for attachment of the support frame in an inclined position between a bathing platform and transom of a boat. An engine mount indicated generally by the reference numeral 4 for receiving and supporting an outboard engine 5 is slidably mounted on the support frame 2 for movement between a lowered engine operating position as shown in FIG. 4 and a raised stored position for supporting the engine 5 out of the water as shown in FIG. 3.

The support frame 2 has an upper front end 6 and a lower rear end 13. The support frame 2 has a pair of spaced-apart parallel channel-section slide rails 7 with in-turned channels 8 for reception of the engine mount 4. The rails 7 are interconnected at their upper end by a cross piece 9. A lower end of each rail 7 is pivotally mounted by bolts 10 to upstanding flanges 11 on a lower mounting bracket 12 of the attachment means 3. Thus, the lower mounting bracket 12 pivots about a horizontal axis. This lower mounting bracket 12 is of L-shape. A liner 14 of rubber or some similar material may be provided on an inside face of the lower mounting bracket 12 to protect the boat to which it is attached and provide good grip. Through holes 15 are provided in the lower mounting bracket 12 for reception of screws or the like for securing the lower mounting bracket 12 to a rear edge of a bathing platform on a boat as shown in FIGS. 3 and 4.

An L-shaped upper mounting bracket 17 forming a second portion of the attachment means 3 is provided adjacent an upper end of the support frame 2. Lugs 18 on the upper mounting bracket 17 are engaged by mounting bolts 19 to secure the upper mounting bracket 17 to downwardly dependent mounting flanges 20 on each slide rail 7 adjacent an upper end of the slide rail 7. A number of spaced-apart through holes 21 are provided on each mounting flange 20 for adjustment of the position of the upper mounting bracket 17 for varying the distance between the mounting brackets 12, 17 to accommodate mounting the assembly 1 on different boats.

The engine mount 4 includes a mounting block 25 supported on an associated carriage 26 which slidably engages the slide rails 7. The carriage 26 has laterally projecting rotatable nylon wheels or rollers 27 which engage in the channels 8 of the slide rails 7 to slide the carriage 26 along the rails 7.

The mounting block 25 has a wooden block 30 attached to a metal backing plate 31 by countersunk screws 32. The backing plate 31 is hingedly mounted by a pivot pin 33, formed by a bolt for example, to the carriage 26 for pivoting about a horizontal axis. The pivot pin 33 engages associated bushings or sleeves (not shown) on the carriage 26 and backing plate 31. A rearwardly projecting web 35 projecting outwardly from the backing plate 31 is engaged by an outer end of a link 36 secured thereto by a bolt 37. An inner end of the link 36 is secured by a bolt 38 to one of a number of spaced-apart through holes 39 in an elongate bar 40 on the carriage 26. Thus the angle of the mounting block 25 relative to the carriage 26 can be adjusted to keep the mounting block 25 in a substantially upright position when the mounting angle of the slide rail 7 is adjusted to accommodate different boats.

FIGS. 3 and 4 show the outboard engine mounting assembly 1 in use for mounting the outboard engine 5 on a boat 50. It will be noted that the support frame 2 is mounted on a transom 51 of the boat 50, the upper mounting bracket 17 being fixed to the transom 51 and the lower mounting bracket 12 being attached to an outer edge of a bathing platform 52 projecting outwardly from the transom 51. Thus the slide rails 7 are supported at an inclined angle. The outboard engine 5 can be moved between a lowered operative position as shown in FIG. 4 and a raised position fully out of the water as shown in FIG. 3 by sliding the carriage 26 along the slide rails 7. Locking means such as a locking pin (not shown) is provided for securing the carriage 26 in the raised position shown in FIG. 3, said locking pin engaging between the support frame 2 and carriage 26. It will be noted that when in this raised stored position the engine 5 does not increase the length of the boat and is supported fully out of the water above the bathing platform.

It will be appreciated that the outboard engine mounting assembly is adjustable to accommodate different boats in which the angle of the support frame 2 can be varied between 20° C. and 60° to the horizontal.

The frame 2 can readily easily pivot on the lower mounting bracket 12 to accommodate any required angle and the upper mounting bracket 7 can be positioned along the mounting flange 20 as required to accommodate different boat constructions. Depending on the angle at which the frame 2 is set the angle of the mounting block 25 can be adjusted appropriately to position it in an upright position for supporting the engine 5 which is releasably clamped thereto in the usual fashion as can be seen in the drawings.

A winch may for example be mounted on the cross piece 9 of the support frame 2 and connected to the engine mount 4. The winch would be operable to raise and lower the engine mount 4 with outboard engine attached.

Referring now to FIGS. 5 to 9 there is shown another outboard engine mounting assembly according to a second embodiment of the invention indicated generally by the reference numeral 60. Parts similar to those described previously are assigned the same reference numerals. In this case the slide rails 7 are formed by F section aluminium extrusions which provide the inwardly facing channels 8 and a downwardly depending flange 61 which projects downwardly at an outside edge of each channel a.

A row of spaced-apart through-holes 21 are provided at an upper end of the flange 61 for adjustable mounting of the attachment means 3 at an upper end of the outboard engine mounting assembly 60. An upper mounting bracket 63 is pivotally mounted at an upper end of the support frame 2. The upper mounting bracket 63 has a pair of arms 64, 65 which extend outwardly from the support frame 2. Inner ends of the arms 64, 65 are each attached by bolts 66 to associated through holes 21 at each side of the support frame 2. These mounting bolts 66 allow pivoting of the arms 64, 65 on the support frame 2 to facilitate mounting the assembly 60 on a boat. An array of spaced-apart through-holes 67 may be provided along each arm 64, 65 to allow length adjustment of the arms 64, 65.

Outer ends of the arms 64, 65 are interconnected by a cross-piece 68 having upturned ends 69 which pivotally engage outer ends of the arm 64, 65 by bolts 70. Through-holes 71 for reception of mounting screws or bolts are provided in the cross-piece 68. The various pieces of the upper mounting bracket 63 can conveniently be formed by aluminium castings.

As for the previous embodiment, the lower mounting bracket 12 is L-shaped and is pivotally attached at a lower end of the support frame 2 by mounting bolts thus pivoting about a horizontal axis. While ideally the lower mounting bracket 12 will be mounted at a lower end of the support frame 2 if desired a number of mounting holes 73 could be provided at a lower end of the flange 61 for adjustment of the lower mounting bracket 12 also if required. It is desirable, however, that when mounted on the batching platform, the frame 2 does not project rearwardly of the bathing platform so the overall length of the boat is not increased, at least not by any significant amount.

A cross-bar 75 is rigidly mounted at an upper end of the support frame 2 having mounting shoes 76 at each end which are a complementary sliding fit in the channel 8. Each mounting shoe 76 is secured by a bolt 78 to the channel 8 at the upper end of the channel.

A cantilevered support arm 80 projects outwardly from a centre of the cross-bar 75 for mounting a winch 82 on the support frame 2. Holes 83 for reception of mounting bolts to secure the winch 82 on the arm 80 are provided in the arm 80. The winch 82 has a generally U-shaped support 84 on which a drum 85 is rotatably mounted by a pivot pin 86. A handle 87 is provided for manually turning the drum 85 to wind a cable 88 on the drum 85. A suitable ratchet mechanism (not shown) is incorporated in the winch 82 to prevent unwanted reversal of the drum 85 as the winch 82 is being operated to raise the engine out of the water.

A free end 89 of the cable 88 has a hook 90 attached for engagement, for example, by means of a shackle 91, with the engine mount 4.

In this case the engine mounting block 25 is an aluminium casting. A tubular sleeve 92 is provided at a lower end of an inside face of the mounting block 25 to receive the pivot pin 33 for pivotally connecting the mounting block 25 to the carriage 26. The carriage 26 is also an aluminium casting. The carriage 26 has a generally rectangular inner slide plate 94 with roller mounting posts 95 at each corner. Each roller mounting post 95 has a through-hole for reception of a mounting bolt 96 which rotatably carries one of the rollers 27 which may conveniently be of nylon material. Projecting outwardly at an angle to the inner slide plate 94 is an engine support 93 which projects outwardly of the support frame 2, the engine mounting block 25 being pivotally mounted at an outer end of the support 93.

A pair of adjuster links 97 extend between the bar 40 on the carriage 26 and the web 35 at a rear of the mounting block 25, being secured to each by mounting bolts 98, 99 which engage with the through-holes 39 in the bar 40 and vertically spaced-apart through-holes 100 in the web 35 for adjusting the orientation of the mounting block 25 on the carriage 26 such that the mounting block 25 supports the engine 5 in an upright position when the assembly 60 is mounted on a boat.

A first eyepiece 102 may be provided at an upper end of the carriage 26 and a complementary second eyepiece 104 may be provided on the cross-bar 75 which can be used to lock the carriage 26 in the uppermost position by means of a shackle or padlock for example.

Figure 8:
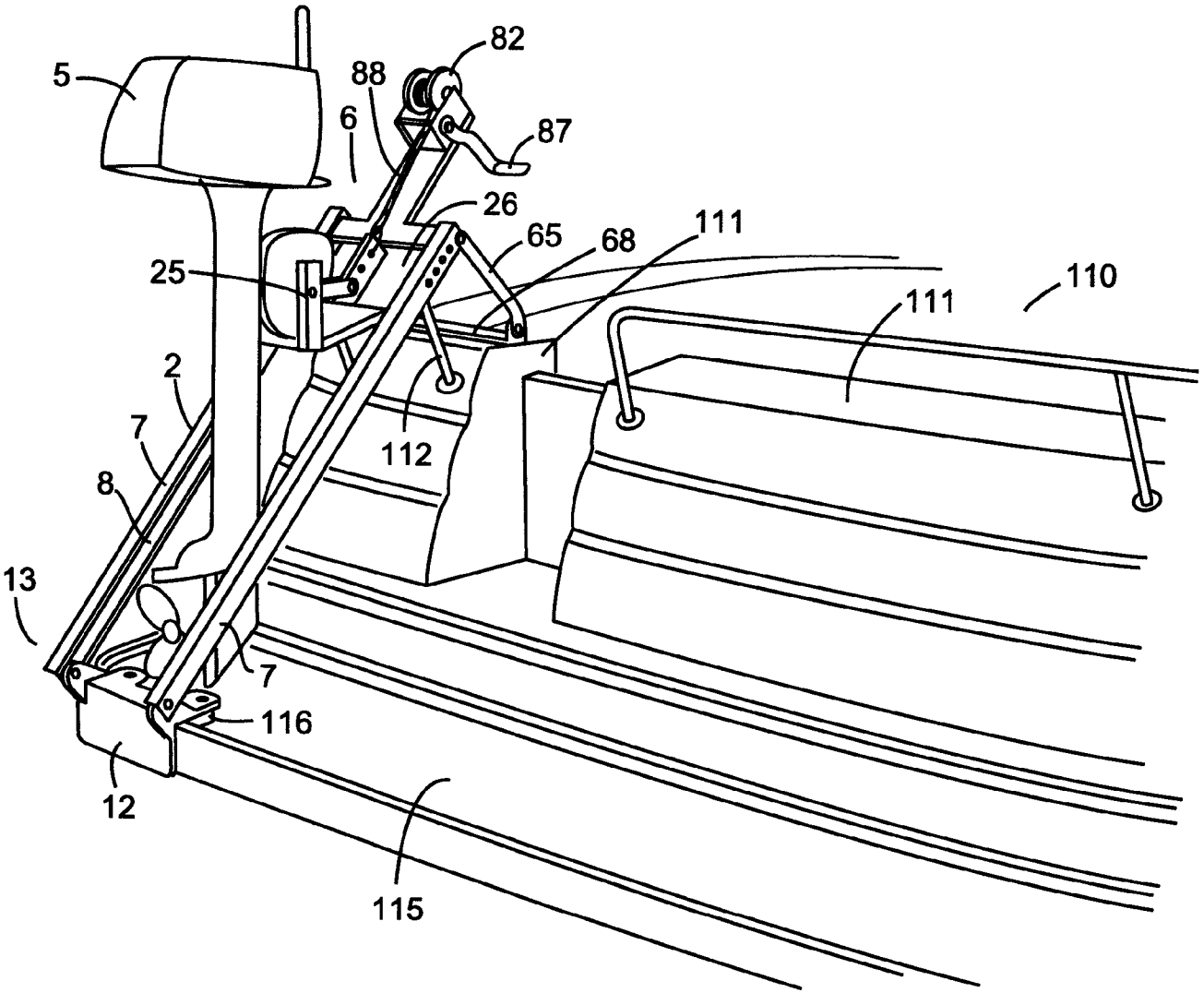
FIG. 8 is a perspective view showing the mounting assembly of FIG. 5 in use mounted at the stern of a boat supporting an auxiliary outboard motor in a raised stored position.
Figure 9:
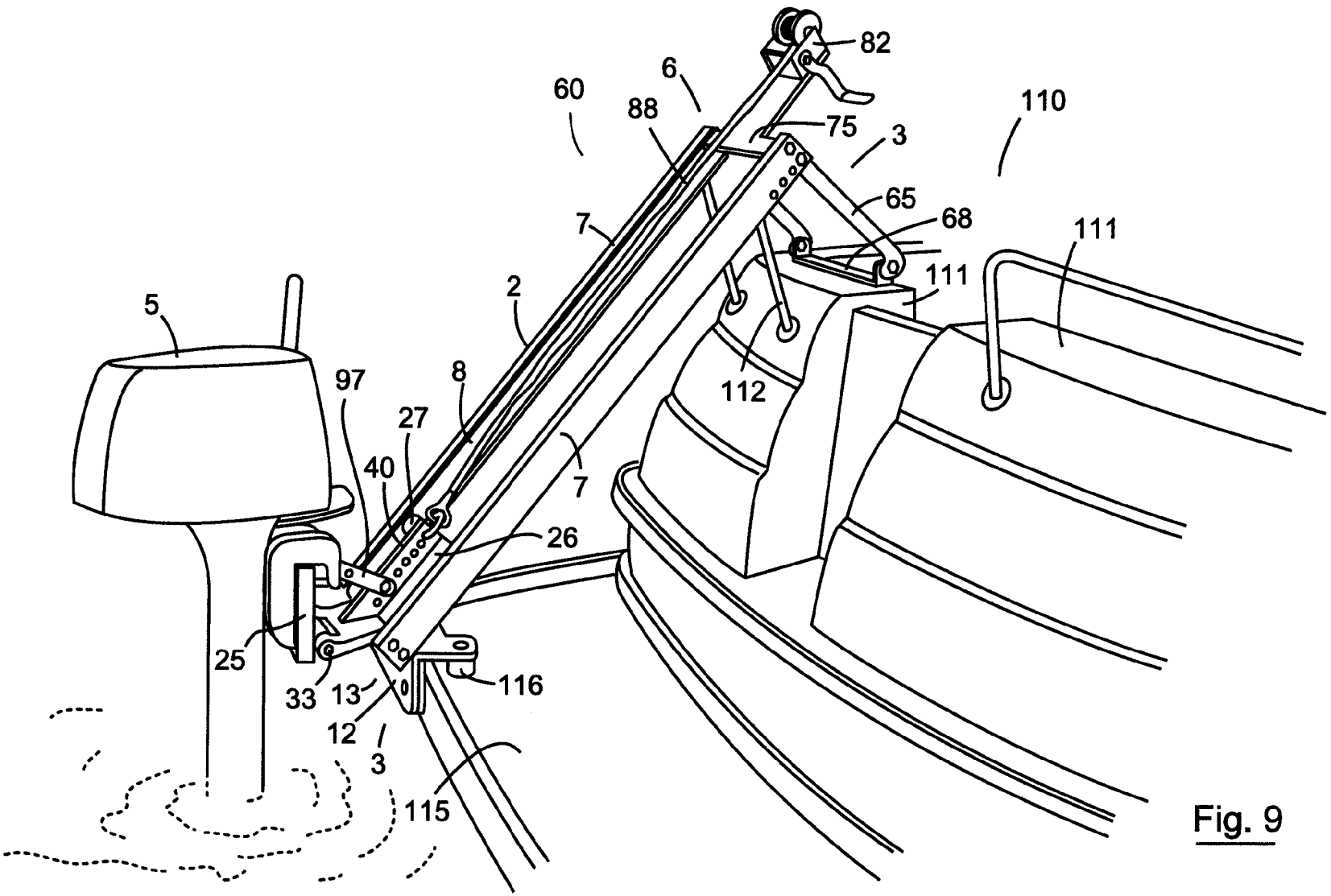
FIG. 9 is a perspective view showing the mounting assembly of FIG. 5 in another portion of use supporting the auxiliary outboard engine in a lowered in-use position.

FIGS. 8 and 9 show the outboard engine mounting assembly 60 mounted at the stern of a boat 110. An upper end of the assembly 60 is secured by the upper mounting bracket 63 to the top of the transom 111 of the boat 110. It will be noted that the arms 64, 65 of the upper mounting bracket 63 bridge across a guardrail 112 on the transom 111 of the boat 110. The lower mounting bracket 12 is secured at a rearmost outer edge of a bathing platform 115 which projects horizontally outwardly of the transom 111. Spacers 116 my be provided between an inner end of the mounting bracket 12 and the top of the bathing platform 115 if required to securely attach the lower mounting bracket 12 to the bathing platform 115.

In use, an outboard engine 5 is secured to the mounting block 25 in the usual way. This can be conveniently carried out by a person standing on the bathing platform 115. Once the engine 5 has been secured the winch 82 can be operated to lower the carriage 26 on the support frame 2. When in the fully lowered position as shown in FIG. 9 the propeller of the engine 5 is in the water and the engine 5 can be used for trolling in the usual way. After use the winch 82 can again be operated to raise the carriage 26 and the engine 5 on the support frame 2 into the fully raised position shown in FIG. 8 in which the engine 5 is stored in an upright position above the bathing platform 115 forwardly of a rear end of the boat formed by a rearmost edge of the bathing platform 115.

The invention is not limited to the embodiments hereinbefore described which may be varied in both construction and detail within the scope of the appended claims.

I claim:

1. An outboard engine mounting assembly for mounting an outboard engine on a boat having a bathing platform spaced downwardly from a top of a transom of the boat and projecting rearwardly from the transom, the assembly including:

a support frame having a front end and a rear end;

attachment means for attachment of said support frame to the boat, an engine mount for receiving and supporting an outboard engine, said engine mount being slidably movable on the support frame between a lowered engine operating position for supporting the engine with its propeller in the water and a raised stored position for supporting the engine out of the water, the attachment means being adapted for mounting the support frame at a desired inclination on the boat extending upwardly and forwardly from the rear end to the front end of the support frame with the rear end of the support frame mounted at a rear edge of the bathing platform and the support frame and engine mount cooperate for supporting the engine forwardly of the rear end of the support frame when the engine mount is in the raised stored position.

2. An outboard engine mounting assembly as claimed in claim 1, wherein a carriage and the support frame are adapted to support the engine between the front end and the rear end of the support frame when the carriage is in the raised position.

3. An outboard engine mounting assembly (1) as claimed in claim 1, wherein engine mount supports the engine in an upright position in both the raised and lowered positions.

4. An outboard engine mounting assembly as claimed in claim 1 wherein the attachment means is adjustable on the support frame.

5. An outboard engine mounting assembly as claimed in claim 1 wherein the attachment means comprises an upper mounting bracket secured at the front end and a lower mounting bracket secured at the rear end of the support frame, at least one of said mounting brackets being adjustable on the support frame to vary the distance between the mounting brackets.

6. An outboard engine mounting assembly as claimed in claim 5 wherein the mounting brackets are pivotally attached to the support frame.

7. An outboard engine mounting assembly as claimed in claim 5 wherein the upper mounting bracket has a pair of arms which extend outwardly from the support frame for bridging across a guardrail on the transom of the boat.

8. An outboard engine mounting assembly as claimed in claim 1 wherein the engine mount has a carriage which slidably engages a complementary pair of slide rails on the support frame.

9. An outboard engine mounting assembly as claimed in claim 8, wherein the carriage has rollers which engage in associated channel slide rails on the support frame to slide the carriage along the support frame.

10. An outboard engine mounting assembly as claimed in claim 1, wherein a pair of spaced-apart in-turned channels are provided on the support frame for reception of laterally projecting rollers rotatably mounted at each side of the carriage.

11. An outboard engine mounting assembly as claimed in claim 1, wherein the support frame and the attachment means cooperate to allow adjustment of the inclination of the support frame between 20° and 60° to the horizontal.

12. An outboard engine mounting assembly as claimed in claim 1 wherein locking means is provided for releasably locking a carriage on the support frame.

13. An outboard engine mounting assembly as claimed in claim 1 wherein the engine mount includes an engine mounting block, said engine mounting block being pivotally mounted on a carriage and means is provided for releasably locking the mounting block on the carriage and for adjusting the orientation of the mounting block relative to the carriage.

14. An outboard engine mounting assembly as claimed in claim 13 wherein the carriage has an engine mounting block pivotally mounted thereon for pivoting about a horizontal pivot between the engine mounting block and the carriage and an adjuster link arm extends between the engine mounting block and the carriage, one or both ends of said link arm being adjustably engaged with the carriage and/or the engine mounting block for adjustment of the angle of the engine mounting block relative to the carriage.

15. An outboard engine mounting assembly as claimed in claim 14 wherein an outer end of the link arm is vertically adjustable on the engine mounting block.

16. An outboard engine mounting assembly as claimed in claim 15, wherein the outer end of the link arm is engaged with a rearwardly projecting web on the engine mounting block, said web having a number of vertically spaced through holes, a bolt connecting between the outer end of the link arm and a selected one of said through holes in the web.

17. An outboard engine mounting assembly as claimed in claim 14, wherein an inner end of the link arm is longitudinally adjustable on the carriage for movement towards and away from the engine mounting block.

18. An outboard engine mounting assembly as claimed in claim 17, wherein an elongate bar on the carriage has a number of spaced-apart through holes, a bolt connecting between the inner end of the link arm and a selected one of said through holes in the bar.

19. An outboard engine mounting assembly as claimed in claim 1, wherein a carriage has an inner slide plate in alignment with slide rails of the support frame and an outer engine support portion angled relative to the slide plate and projecting outwardly between the slide rails, the engine mounting block being pivotally mounted at an outer end of the engine support portion.

20. An outboard engine mounting assembly as claimed in claim 1 wherein a winch is mounted on the support frame said winch having a cable wound on a drum, the cable being connected to the engine mount and the winch being operable to raise and lower the engine mount on the support frame.

* * * * *